US010317125B2

(12) United States Patent
Xu et al.

(10) Patent No.: US 10,317,125 B2
(45) Date of Patent: Jun. 11, 2019

(54) REFRIGERATOR

(71) Applicant: HISENSE RONSHEN (GUANGDONG) REFRIGERATOR CO., LTD., Guangdong (CN)

(72) Inventors: Jinchao Xu, Guangdong (CN); Haiyan Wang, Guangdong (CN); Zhe Hu, Guangdong (CN); Feiyue You, Guangdong (CN); Meiyan Wang, Guangdong (CN); Dong Kong, Guangdong (CN)

(73) Assignee: HISENSE RONSHEN (GUANGDONG) REFRIGERATOR CO., LTD., Guangdong (CN)

( * ) Notice: Subject to any disclaimer, the term of this patent is extended or adjusted under 35 U.S.C. 154(b) by 81 days.

(21) Appl. No.: 15/387,929

(22) Filed: Dec. 22, 2016

(65) Prior Publication Data

US 2017/0097184 A1 Apr. 6, 2017

Related U.S. Application Data

(63) Continuation of application No. PCT/CN2015/095263, filed on Nov. 23, 2015.

(30) Foreign Application Priority Data

Jan. 7, 2015 (CN) ..... 2015 1 0009262
Mar. 11, 2015 (CN) ..... 2015 1 0107398

(51) Int. Cl.
*F25D 23/02* (2006.01)
*E05F 15/665* (2015.01)
(Continued)

(52) U.S. Cl.
CPC ..... *F25D 23/021* (2013.01); *E05D 15/165* (2013.01); *E05F 11/42* (2013.01);
(Continued)

(58) Field of Classification Search
CPC .... F25D 23/021; F25D 23/025; E05F 15/665; E05F 15/643; E05F 11/445; E05F 11/44; E05F 11/42; E05F 11/483
See application file for complete search history.

(56) References Cited

U.S. PATENT DOCUMENTS 4,177,606 A * 12/1979 Jeavons ..... E05F 11/445 49/351
5,595,025 A * 1/1997 MacPhail-Fausey ..... E05F 15/689 49/351

(Continued)

FOREIGN PATENT DOCUMENTS

CN 1699901 A 11/2005
CN 102022889 A 4/2011

(Continued)

OTHER PUBLICATIONS

International Search Report and Written Opinion PCT/CN2015/095263 dated Jan. 27, 2016.

(Continued)

*Primary Examiner* — Justin B Rephann
(74) *Attorney, Agent, or Firm* — McDermott Will & Emery LLP

(57) ABSTRACT

The present invention discloses a refrigerator and relates to the technical field of refrigerators. The refrigerator is invented to settle problems, such as increased external space occupied by a refrigerator when its secondary door is opened, increased difficulty in fetching goods in the refrigerator, and heavy loss of cooling capacity resulted from the full opening of an opening. The inventive refrigerator comprises a main door; an opening is formed on a door body of the main door; a guide rail is provided at an edge of the opening, and a secondary door is fitted on the guide rail; and the secondary door is connected with a driving mechanism (Continued)

which can drive the secondary door to slide along the guide rail, and as the secondary door slides along the guide rail, the secondary door can enclose or open the opening. The refrigerator of the present invention is used for preserving and freezing foods.

19 Claims, 11 Drawing Sheets

(51) Int. Cl.

| | |
|---|---|
| ***E05D 15/16*** | (2006.01) |
| ***E06B 7/32*** | (2006.01) |
| ***F25D 11/00*** | (2006.01) |
| ***F25D 23/08*** | (2006.01) |
| ***E05F 11/42*** | (2006.01) |
| ***E05F 11/44*** | (2006.01) |
| ***E05F 11/48*** | (2006.01) |
| ***E05F 15/643*** | (2015.01) |

(52) U.S. Cl.

CPC ..... *E05F 11/44* (2013.01); *E05F 11/483* (2013.01); *E05F 15/643* (2015.01); *E05F 15/665* (2015.01); *E06B 7/32* (2013.01); *F25D 11/00* (2013.01); *F25D 23/028* (2013.01); *F25D 23/087* (2013.01); *E05Y 2800/71* (2013.01); *E05Y 2900/31* (2013.01); *F25D 2201/14* (2013.01); *F25D 2323/023* (2013.01)

(56) References Cited

U.S. PATENT DOCUMENTS

| | | | | | |
|---|---|---|---|---|---|
| 6,041,549 | A * | 3/2000 | Schust | E05F 11/385 | 49/375 |
| 6,477,806 | B1 * | 11/2002 | Asada | E05D 15/101 | 296/146.2 |
| 8,650,800 | B2 * | 2/2014 | Anderson | E05F 11/445 | 49/351 |
| 2006/0261220 | A1 * | 11/2006 | Lee | F16M 13/02 | 248/27.1 |
| 2009/0188168 | A1 * | 7/2009 | Shirai | E05F 15/697 | 49/349 |
| 2010/0072870 | A1 * | 3/2010 | Hwang | F25D 23/025 | 312/405 |
| 2010/0281911 | A1 * | 11/2010 | Ha | F25D 25/022 | 62/449 |
| 2010/0287838 | A1 * | 11/2010 | Kitayama | E05F 5/003 | 49/156 |
| 2011/0023511 | A1 * | 2/2011 | Lee | B67D 1/0857 | 62/178 |
| 2011/0314740 | A1 * | 12/2011 | Mori | E05F 11/445 | 49/349 |
| 2012/0103002 | A1 * | 5/2012 | Lee | F25D 23/02 | 62/389 |
| 2013/0214664 | A1 * | 8/2013 | Yoon | F16L 59/065 | 312/405 |
| 2015/0260443 | A1 * | 9/2015 | Lee | F25D 23/02 | 312/404 |
| 2016/0061514 | A1 * | 3/2016 | Seo | F21V 14/003 | 312/404 |
| 2016/0312532 | A1 * | 10/2016 | Kuhnl-Kinel | E06B 11/025 | |

FOREIGN PATENT DOCUMENTS

| | | | |
|---|---|---|---|
| JP | S47-7197 | Y1 | 3/1972 |
| JP | S52-33818 | A | 3/1977 |
| JP | S58-188473 | U | 12/1983 |
| JP | S59-134673 | U | 9/1984 |
| JP | S60-1872 | U | 1/1985 |
| JP | H02-30884 | U | 2/1990 |
| JP | H07-276999 | A | 10/1995 |
| JP | H08-117123 | A | 5/1996 |
| JP | 2003-003724 | A | 1/2003 |
| JP | 2010-71565 | A | 4/2010 |
| JP | 2011-246988 | A | 12/2011 |
| KR | 10-2010-0071306 | A | 6/2010 |

OTHER PUBLICATIONS

Notification of First Rejection of Japanese Patent Application No. 2016-547910 dated Jun. 27, 2017 (with English translation).

Notification of Final Rejection of Japanese Patent Application No. 2016-547910 dated Mar. 16, 2018 (with English translation).

Office Action in Korean Application No. 10-2017-7004292 dated Feb. 16, 2017 (with English translation).

Extended European Search Report issued in European Application No. 15876661.8 dated Jul. 20, 2017.

First Office Action issued in Chinese Application No. 201510107398.3 dated Jan. 2, 2018 (with English translation).

* cited by examiner

REFRIGERATOR

CROSS-REFERENCE TO RELATED APPLICATIONS

This application is a Bypass Continuation Application of PCT/CN2015/095263 filed Nov. 23, 2015, which claims priority to Chinese Patent Application No. 201510009262.9, submitted to Chinese Patent Office on Jan. 7, 2015, titled "REFRIGERATOR", and Chinese Patent Application No. 201510107398.3, submitted to Chinese Patent Office on Mar. 11, 2015, titled "REFRIGERATOR", the entirety of each is incorporated herein by reference.

FIELD OF TECHNOLOGY

The present invention relates to the technical field of refrigerators, and in particular to a refrigerator.

BACKGROUND

With the improvement of people's life quality, a gradually increasing storage requirement for a refrigerator makes refrigerator products with a large capacity become popular. However, an enlarged capacity will lead to a correspondingly increased size of the refrigerator, and the door body of the refrigerator will also become taller and wider. Because users will frequently open the large-sized door body when they fetch goods, cooling capacity in the refrigerator will leak heavily which causes a compressor to frequently start and thus leads to increased energy consumption of the refrigerator. In addition, due to the deeper depth of the refrigerator, it will be more difficult for users to fetch goods if the goods are not placed in good classification, when a large number of goods are stored in the refrigerator.

FIG. 1 is a refrigerator in the prior art, including a refrigerator door 01. A storage space (not shown) is provided on the refrigerator door 01. A secondary door 03 is provided outside of an opening 02 of the storage space. A revolving shaft 04 of the secondary door 03 is arranged horizontally on the bottom of the opening 02. The secondary door 03 is rotated about the revolving shaft 04 to open or enclose the opening 02. Because commonly used goods are arranged inside the storage space on the refrigerator door 01, it is just needed to open the secondary door 03 when users fetch them. This avoids opening and closing the large-sized refrigerator door 01 frequently, thereby reducing the leakage of the cooling capacity in the refrigerator and decreasing the energy consumption of the refrigerator.

When the secondary door 03 is opened, an angle between the secondary door 03 and the refrigerator door 01 will become larger as the secondary door 03 rotates about the revolving shaft 04, leading to increased space occupied by the refrigerator. The secondary door 03 will occupy a certain external space when it is fully opened, causing unnecessary limitations. And, the secondary door 03 sometimes blocks in front of the human body and thus increases the difficulty in fetching goods. In addition, opening the door each time will cause the full opening of the opening 02 on the refrigerator door 01. As a result, loss of cooling capacity remains heavy.

SUMMARY OF THE INVENTION

Embodiments of the present invention provide a refrigerator which may solves problems such as increased external space occupied by a refrigerator when its secondary door is opened, increased difficulty in fetching goods in the refrigerator, and heavy loss of cooling capacity resulted from the full opening of the opening.

In order to achieve this objective, the embodiments of the present invention adopt the following technical solution.

A refrigerator is provided, including a main door; an opening is formed on a door body of the main door; a guide rail is provided at an edge of the opening, and a secondary door is fitted on the guide rail; and the secondary door is connected with a driving mechanism which can drive the secondary door to slide along the guide rail, and as the secondary door slides along the guide rail, the secondary door can enclose or open the opening.

The embodiments of the present invention provide a refrigerator. The secondary door is provided on the main door. When users fetch goods, the opening on the main door can be opened by driving the secondary door to slide along the guide rail by the driving mechanism, so that it is possible to fetch the goods in the refrigerator; and the opening on the main door can be enclosed by driving the secondary door by the driving mechanism to slide along the guide rail in the opposite direction. With regard to the refrigerator provided by the embodiments of the present invention, a small-sized secondary door can be opened partially or fully when users fetch the commonly used goods, so as to reduce the loss of cooling capacity, fetch and place goods conveniently, and improve the user experience. Furthermore, the secondary door, when opened, is located in the main door and in a same plane as the main door, so that it will not block in front of the human body and will not exert an influence on the external space occupied by the refrigerator and the difficulty in fetching goods.

BRIEF DESCRIPTION OF THE DRAWINGS

In order to describe technical solutions in the embodiments of the present invention or in the prior art more clearly, the accompanying drawings to be used for describing the embodiments or the prior art will be introduced briefly. Obviously, the accompanying drawings to be described below are merely some embodiments of the present invention, and a person of ordinary skill in the art can obtain other drawings according to those drawings without paying any creative effort.

DETAILED DESCRIPTION OF THE PREFERRED EMBODIMENTS

The technical solutions in the embodiments of the present invention will be described clearly and completely with reference to the accompanying drawings in the embodiments of the present invention. Obviously, the embodiments to be described are merely some but not all of embodiments of the present invention. Based on the embodiments of the present invention, all other embodiments obtained by a person of ordinary skill in the art without paying any creative effort are included the protection scope of the present invention.

In the description of the present invention, it should be understood that orientation or location relationships indicated by terms "center", "up", "down", "front", "behind", "left", "right", "vertical", "horizontal", "top", "bottom", "inside", "outside" and the like are the orientation or location relationships based on the accompanying drawings, provided just for ease of describing the present invention and simplifying the description. They are not intended to indicate or imply that the stated devices or elements must have the specific orientation and be constructed and operated in the specific orientation. Hence, they shall not be understood as any limitation to the present invention.

Terms "first" and "second" are simply used for description, and shall not be understood to indicate or imply relative importance or to imply the amount of the stated technical features. Therefore, features defined with "first" and "second" can explicitly or impliedly include one or more such features. In the description of the present invention, "more" means "two or more than two", unless otherwise specifically stated.

In the description of the present invention, it should be noted that, unless otherwise clearly specified and defined, terms "mount", "connected with" and "connected to" should be understood in a broad sense, for example, it can be fixed connection, and can also be detachable connection or integral connection; and, it can be direct connection, can also be connection by intermediate members, and can be internal connection between two elements. For a person of ordinary skill in the art, the specific meaning of those terms in the present invention can be understood in specific circumstances.

The refrigerator mainly comprises a cabinet, a main door, a refrigerating system and a controlling system. A storage space is provided in the cabinet, and a storage space may be provided on one side of the main door close to the inside of the cabinet. Users can fetch goods in the above storage spaces by opening the main door. The refrigerating system comprises a compressor and so on, and is configured to lower temperature in the cabinet in order to refrigerate goods. The controlling system comprises a temperature controller and so on, and is configured to control the temperature in the cabinet to be within a range.

Figure 1:
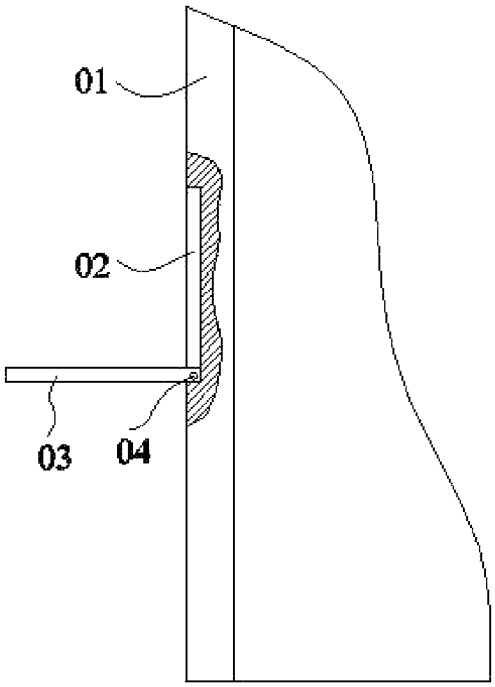
FIG. 1 is a side view of a refrigerator door in the prior art.
Figure 2:
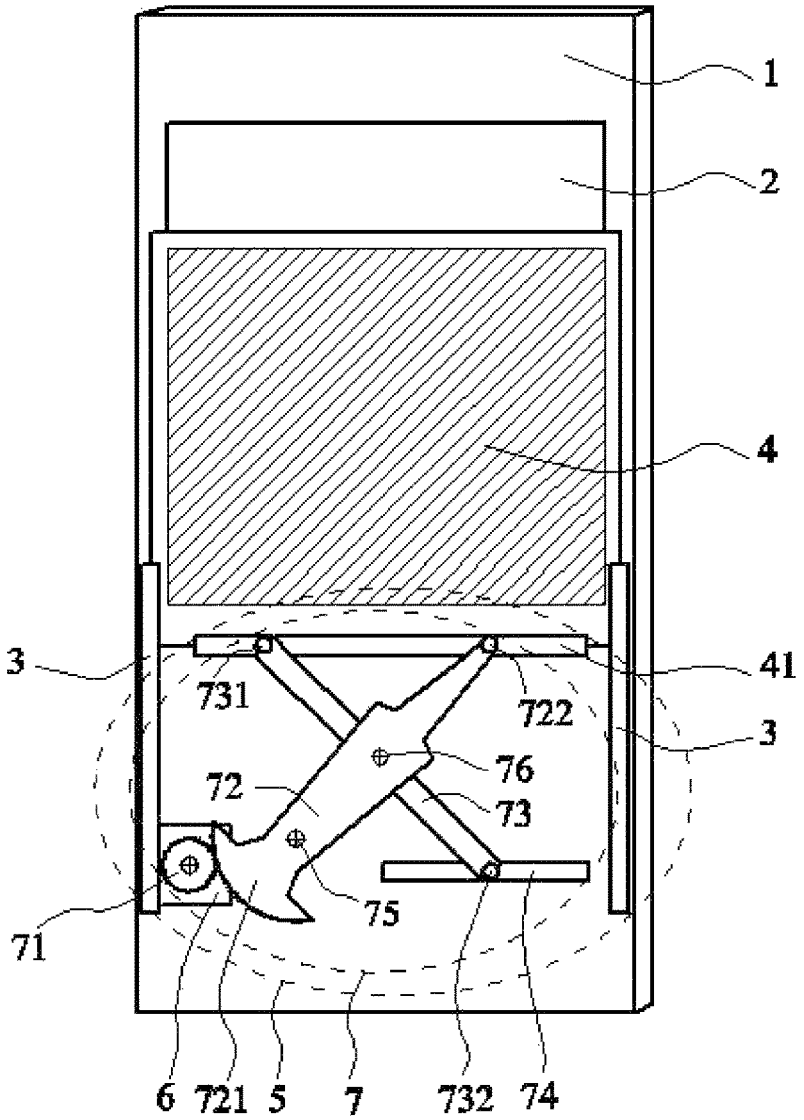
FIG. 2 is a schematic structure diagram of a main door according to one embodiment of the present invention.

FIG. 2 is one specific embodiment of the refrigerator according to the embodiments of the present invention. The refrigerator in this embodiment includes a main door 1; an opening 2 is formed on the door body of the main door 1; a guide rail 3 is provided at an edge of the opening 2, and a secondary door 4 is fitted on the guide rail 3; and the secondary door 4 is connected to a driving mechanism 5 which can drive the secondary door 4 to slide along the guide rail 3, and as the secondary door 4 slides along the guide rail 3, the secondary door 4 can enclose or open the opening 2.

With regard to the refrigerator provided in this embodiment of the present invention, the secondary door 4 is provided on the main door 1, and the opening 2 on the main door 1 can be opened by driving the secondary door 4 to slide along the guide rail 3 by the driving mechanism 5 so that it is possible to fetch the goods in the refrigerator; and the opening 2 on the main door 1 can be enclosed by driving the secondary door 4 by the driving mechanism 5 to slide along the guide rail 3 in the opposite direction. With regard to the refrigerator provided in this embodiment of the present invention, the small-sized secondary door 4 can be opened partially or fully when users fetch the commonly used goods, so as to reduce the loss of cooling capacity in the refrigerator, fetch and place goods conveniently for users, and improve the user experience. Furthermore, the secondary door 4, when opened, is located in the main door 1 and in a same plane as the main door 1, so that it will not block in front of the human body and will not exert an influence on the external space occupied by the refrigerator and the difficulty in fetching goods. By opening the secondary door by sliding the secondary door 4 along the guide rail 3, the door hinge parts, which are easy to wear, are omitted, and the durability of the secondary door 4 is enhanced. In addition, the opening or enclosing of the secondary door 4 can be implemented by the driving mechanism 5, which is beneficial to the automation development of refrigerators.

The arrangement of the guide rail 3 at an edge of the opening 2 can be implemented in the following two ways. The first implementation way is to arrange the guide rail 3 at an edge of only one side of the opening 2. In this case, the sliding of the secondary door 4 can be implemented by limiting the edge of the one side of the secondary door 4 by the guide rail 3 on the corresponding one side, and as a result, the sliding stability of the secondary door 4 is relatively low. The second implementation way is to arrange parallel guide rails 3 at two opposite edges of the opening 2, respectively. Such implementation, in which edges of two sides of the secondary door 4 are limited by guide rails 3 on the two sides, makes the secondary door 4 slide more smoothly and stably. Therefore, it is preferable to arrange guide rails 3 at the two opposite edges of the opening 2, respectively.

In this embodiment, the driving mechanism 5 includes a motor 6 and a transmission assembly 7; an output shaft of the motor 6 is connected to the transmission assembly 7 in a transmission way, and the transmission assembly 7 is connected to the secondary door 4 in a transmission way; and the transmission assembly 7 can transform a rotary motion of the output shaft of the motor 6 to a linear motion to drive the secondary door 4 to slide along the guide rail 3. Power of the motor 6 is transmitted to the secondary door 4 by the transmission assembly 7, to drive the secondary door 4 to slide along the guide rail 3, so as to realize the opening and enclosing of the opening 2 on the main door 1.

FIG. 2 is one implementation of the transmission assembly 7, including a first gear 71, a first connecting rod 72 and a second connecting rod 73; the first connecting rod 72 is connected to the door body of the main door 1 by a first shaft 75, and the first connecting rod 72 can rotate about the first shaft 75; the second connecting rod 73 is hinged with the first connecting rod 72 by a second shaft 76; the first gear 71 is fixed onto the output shaft of the motor 6; one end of the first connecting rod 72 is a gear structure 721, and the other end thereof is connected with a first guide pin 722; the gear structure 721 is engaged with the first gear 71; a first chute 41 perpendicular to the guide rail 3 is provided on one side of the secondary door 4 close to the driving mechanism 5, and the first guide pin 722 is fitted inside the first chute 41; one end of the second connecting rod 73 is connected with a second guide pin 731 and the other end thereof is connected with a third guide pin 732, and the second guide pin 731 is fitted inside the first chute 41; and a second chute 74 perpendicular to the guide rail 3 is provided on the door body of the main door 1, and the third guide pin 732 is fitted inside the second chute 74. When the secondary door 4 changes to the opened position from the closed position, the motor 6 starts, and drives the first gear 71 to rotate about the motor shaft counterclockwise. Because the first gear 71 is engaged with the gear structure 721, the first gear 71 drives the first connecting rod 72 to rotate about the first shaft 75 clockwise, and drives the second shaft 76 to rotate about the first shaft 75 clockwise. In this case, the first guide pin 722 slides along the first chute 41 in a direction away from the first gear 71; the second connecting rod 73 rotates about the second shaft 76 counterclockwise, so that the second guide pin 731 slides along the first chute 41 in a direction opposite to the sliding direction of the first guide pin 722; and the third guide pin 732 slides along the second chute 74 in a direction the same as the sliding direction of the first guide pin 722, so as to drive the secondary door 4 to slide along the guide rail 3 in a direction close to the first gear 71 until the opening 2 is fully opened. When the secondary door 4 changes to the closed state from the opened state, the motor 6 starts, and drives the first gear 71 to rotate about the motor shaft clockwise. Because the first gear 71 is engaged with the gear structure 721, the first gear 71 drives the first connecting rod 72 to rotate about the first shaft 75 counterclockwise, and drives the second shaft 76 to rotate about the first shaft 75 counterclockwise. In this case, the first guide pin 722 slides along the first chute 41 in a direction close to the first gear 71; the second connecting rod 73 rotates about the second shaft 76 clockwise, so that the second guide pin 731 slides along the first chute 41 in a direction opposite to the sliding direction of the first guide pin 722; and the third guide pin 732 slides along the second chute 74 in a direction the same as the sliding direction of the first guide pin 722, so as to drive the secondary door 4 to slide along the guide rail 3 in a direction away from the first gear 71 until the opening 2 is fully enclosed. Power of the motor 6 is transmitted to the first connecting rod 72 and the second connecting rod 73 by engaging the first gear 71 and the gear structure 721 on the first connecting rod 72, so that the first connecting rod 72 and the second connecting rod 73 drive the secondary door 4 to slide along the guide rail 3 smoothly and stably, so as to realize the opening and enclosing of the opening 2. The bearing capacity and impact resistance of the transmission assembly 7 are so high that there is a relatively small abrasion during the transmission. Furthermore, the manufacturing is convenient and it is easy to obtain a relatively high precision when producing a refrigerator.

In the above embodiment, because the second chute 74 is formed on the door body of the main door 1, strength at the corresponding position of the main door 1 will be reduced. If the second chute 74 is damaged, the main door 1 will be scraped entirely. In order to avoid this case, in another embodiment of the present invention, a support rod (not shown) perpendicular to the guide rail 3 is preferably arranged on the door body of the main door 1, and the second chute 74 is formed on the support rod. The third guide pin 732 is fitted inside the second chute 74. Therefore, when the second chute 74 is damaged, it is just needed to replace the support rod. This prevents the main door 1 from entirely scraping and also guarantees the strength of the main door 1 not being impacted.

In the above embodiment, because only some of teeth in the gear structure 721 are used during the swing process of the first connecting rod 72, in order to save material of the gear structure 721 and simplify its processing process, the gear structure 721 is preferably a sector gear structure as shown in FIG. 2.

Figure 3:
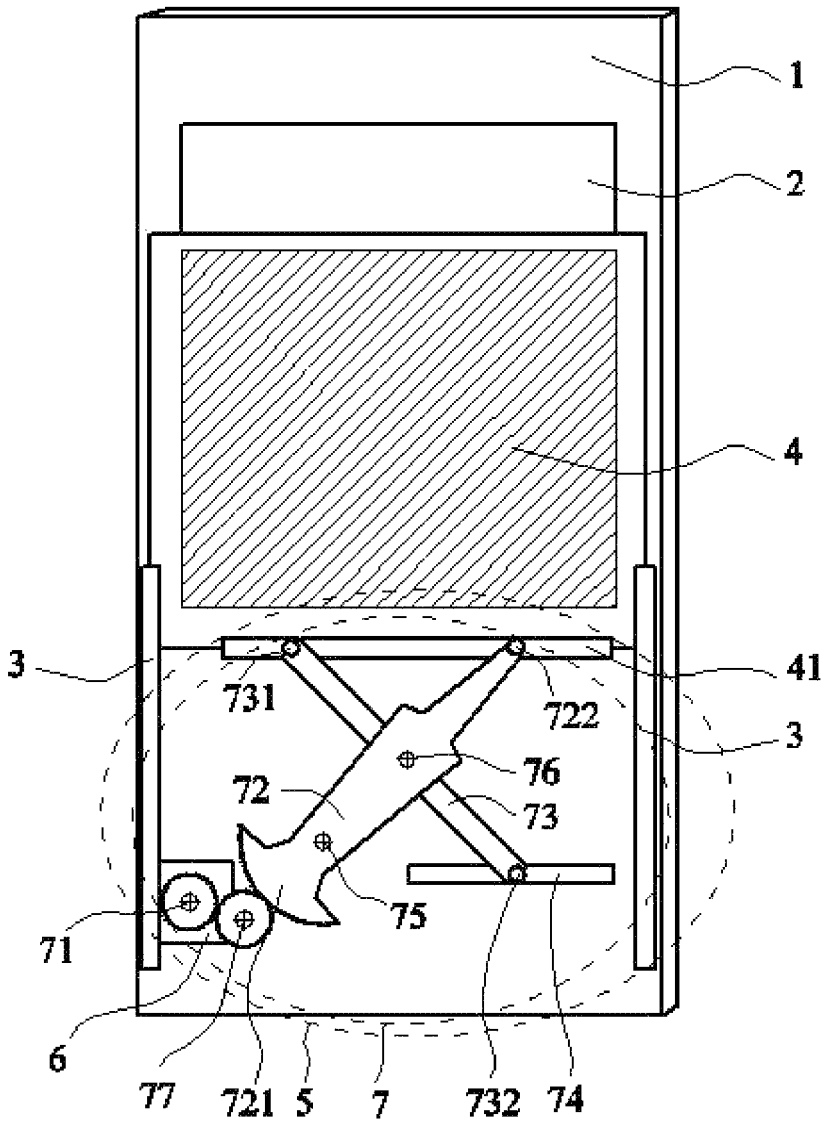
FIG. 3 is a schematic structure diagram of a second gear provided in a transmission assembly according to one embodiment of the present invention.

With reference to FIG. 3, the transmission assembly 7 in one embodiment of the invention also includes a second gear 77, and the gear structure 721 is engaged with the first gear 71 by the second gear 77.

Another implementation of the transmission assembly 7 can adopt a gear rack for transmission, including a transmission gear, a rack and a rack guide rail; the rack guide rail is fixed onto the door body of the main door 1, the gear guide rail is in parallel to the guide rail 3, and the rack can slide along the rack guide rail and one end of the rack is connected to the secondary door 4; and the transmission gear is connected with an output shaft of the motor 6 in a transmission way, and engaged with the rack. When the secondary door 4 changes to the opened state from the closed state, the motor 6 starts, and drives the transmission gear to rotate about the motor shaft counterclockwise. In this case, the rack engaged with the transmission gear slides along the rack guide rail so as to drive the secondary door 4 to slide along the guide rail 3 in a direction close to the transmission gear until the opening 2 is fully opened. When the secondary door 4 changes to the closed state from the opened state, the motor 6 starts, and drives the transmission gear to rotate about the motor shaft clockwise. In this case, the rack engaged with the transmission gear slides along the rack guide rail so as to drive the secondary door 4 to slide along the guide rail 3 in a direction away from the transmission gear until the opening 2 is fully closed. The rotary motion of the output shaft of the motor 6 is transformed to a linear motion by the gear rack. The secondary door 4 is driven to slide along the guide rail 3, so as to realize the opening and enclosing of the opening 2. Such transmission assembly 7 can ensure a constant transmission ratio, high transmission efficiency, and smooth and stable transmission, so that the secondary door 4 slides more smoothly and stably along the guide rail 3. In this way, the service life becomes longer.

In the above embodiment, there can be one transmission gear, one rack and one rack guide rail. The motor 6 drives this transmission gear to rotate when it starts. The rotation of the transmission gear drives the rack engaged with the transmission gear to slide along the rack guide rail, so as to drive the secondary door 4 to slide along the guide rail and thus to realize the opening and closing of the opening 2.

Figure 4:
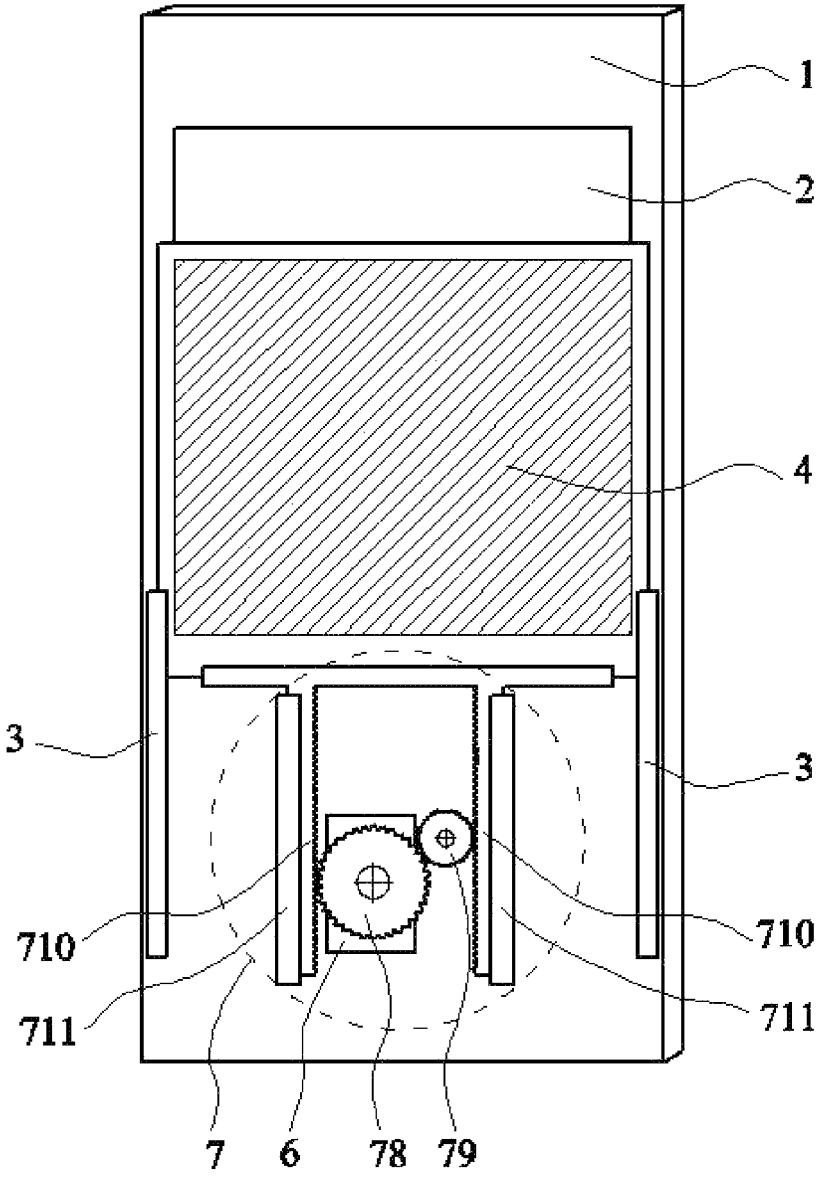
FIG. 4 is a schematic structure diagram of a transmission assembly, which is a gear rack, according to one embodiment of the present invention.

In another embodiment of the present invention, there can be two transmission gears, two racks and two rack guide rails. With reference to FIG. 4, specifically, the transmission gear includes two gears, i.e., a third gear 78 and a fourth gear 79. There are two racks 710 and two rack guide rails 711. The two racks 710 are spaced apart from each other and in parallel to the guide rail 3, and one end of each of the two racks 710 is connected with the secondary door 4. The two rack guide rails 711 are spaced apart from each other and in parallel to the guide rail 3. The two racks 710 are fitted on the two rack guide rails 711, respectively. The third gear 78 is fixed on the output shaft of the motor 6, and is engaged with one rack 710 and the fourth gear 79, respectively. The fourth gear 79 is engaged with the other rack 710. When the secondary door 4 changes to the opened state from the closed state, the motor 6 starts and drives the third gear 78 to rotate about the motor shaft counterclockwise. In this case, the fourth gear 79 engaged with the third gear 78 rotates about its rotary center clockwise; the third gear 78 and the fourth gear 79 drive the secondary door 4 to slide along the guide rail 3 in a direction close to the third gear 78 until the opening 2 is fully opened, by driving two racks 710 engaged with them to slide along the rack guide rail 711. When the secondary door 4 changes to the closed state from the opened state, the motor 6 starts, and drives the third gear 78 to rotate about the motor shaft clockwise. In this case, the fourth gear 79 engaged with the third gear 78 rotates its rotary center counterclockwise. The third gear 78 and the fourth gear 79 drive the secondary door 4 to slide along the guide rail 3 in a direction away from the third gear 78 until the opening 2 is fully closed, by driving two racks 710 engaged with them to slide along the rack guide rail 711. Because there are two transmission gears, two racks and two rack guide rails, the secondary door 4 is driven from two sides. Compared with driving the secondary door 4 from one side, this implementation enables the secondary door 4 to be stressed more evenly, preventing the secondary door 4 from being jammed during the sliding. Therefore, it is preferred that there are two transmission gears, two racks and two rack guide rails.

Figure 5:
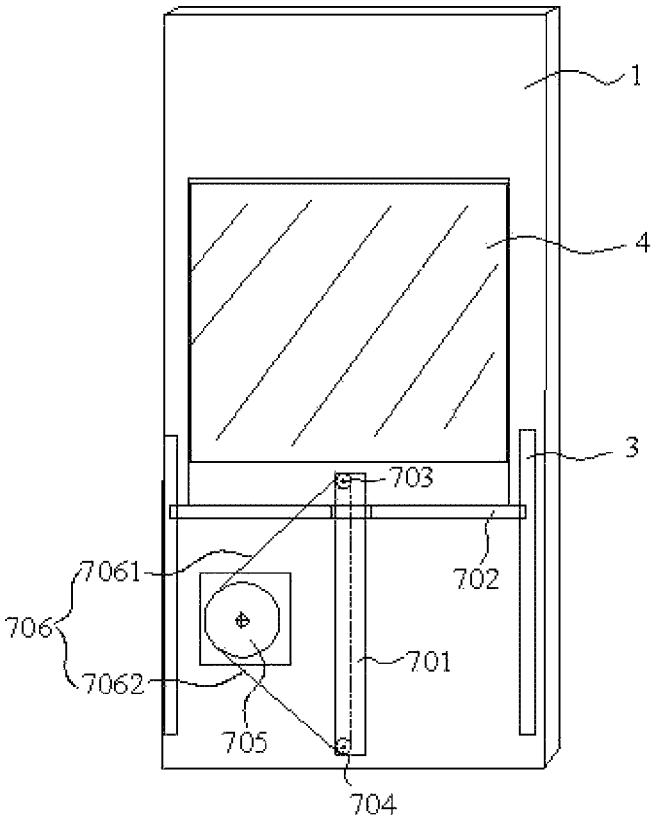
FIG. 5 is a schematic overall structure diagram in which a secondary door is driven by a transmission rope according to one embodiment of the present invention.
Figure 6:
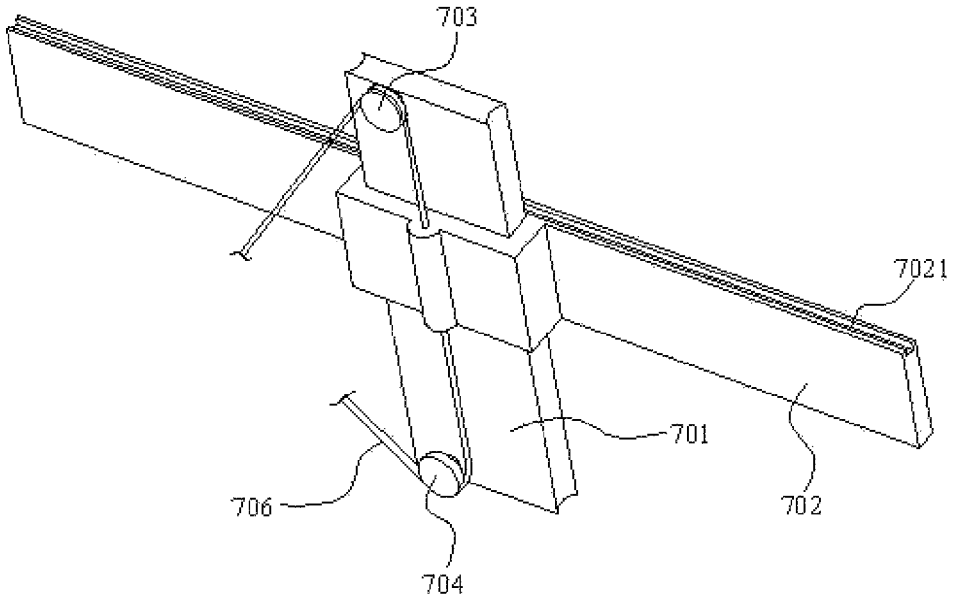
FIG. 6 is a partially schematic structure diagram of the transmission assembly of FIG. 5.

As shown in FIG. 5 and FIG. 6, in another embodiment of the present invention, the transmission assembly 7 includes a guide block 701 which is arranged along a direction in parallel to the guide rail 3; at both ends of the guide block 701, a first guide wheel 703 and a second guide wheel 704 are provided, respectively; a driving wheel 705 is sleeved on the output shaft of the motor 6; the secondary door 4 includes a sliding bottom plate 702 which is sleeved on the guide block 701 and can slide along the guide block 701; the sliding bottom plate 702 is located between the first guide wheel 703 and the second guide wheel 704 and connected with a transmission rope 706; the transmission rope 706 includes a first transmission rope segment 7061 and a second transmission rope segment 7062 which are located on both sides of the sliding bottom plate 702, respectively; and the first transmission rope segment 7061 is passed over the first guide wheel 703 and wound onto the driving wheel 705 in a first direction, and the second transmission rope segment 7062 is passed beneath the second guide wheel 704 and wound onto the driving wheel 705 in a direction opposite to the first direction.

The operating process of the above embodiment is as follows. When the secondary door 4 moves from the opened position to the closed position, the output shaft of the motor 6 drives the driving wheel 705 to rotate counterclockwise, so as to pull the first transmission rope segment 7061 and release the second transmission rope segment 7062, so that the transmission rope located between the first guide wheel 703 and the second wheel 704 moves upward because of being partially stressed and then, guided by the guide block 701 and the guide rail 3 in terms of direction, pulls the sliding bottom plate 702 in order to drive the secondary door 4 to move upward to reach the closed position. When the secondary door 4 moves from the closed position to the opened position, the output shaft of the motor 6 drives the driving wheel 705 to rotate clockwise, so as to pull the second transmission rope segment 7062 and release the first transmission rope segment 7061, so that the transmission rope located between the first guide wheel 703 and the second wheel 704 moves downward and then, guided by the guide block 701 and the guide rail 3 in terms of direction, pulls the sliding bottom plate 702 in order to drive the secondary door 4 to move downward drive to reach the opened state. In a transmission structure shown in FIG. 5, compared with a common transmission structure, the number of components and parts assembled is reduced, and the production efficiency is increased. Furthermore, because the transmission rope is continuously coordinated with the driving wheel and the guide wheels, and the transmission rope is a flexible member, compared with gear transmission, the friction and collision between the teeth generated when engaged with each other are avoided, and as a result, noise generated during the transmission is reduced.

In order to make the stressed direction of the secondary door consistent with the arrangement direction of the guide rail 3, a portion of the transmission rope 706 located between the first guide wheel 703 and the second wheel 704 can be made in parallel to the guide rail 3 by arranging the positions and sizes of the first guide wheel 703 and the second guide wheel 704. For example, the first guide wheel 703 and the second wheel 704 can be set to have an equal radius and their centers can be located in a same straight line. Therefore, the stressed direction of the secondary door is made consistent with the arrangement direction of the guide rail 3. This avoids jamming during the movement.

Figure 7:
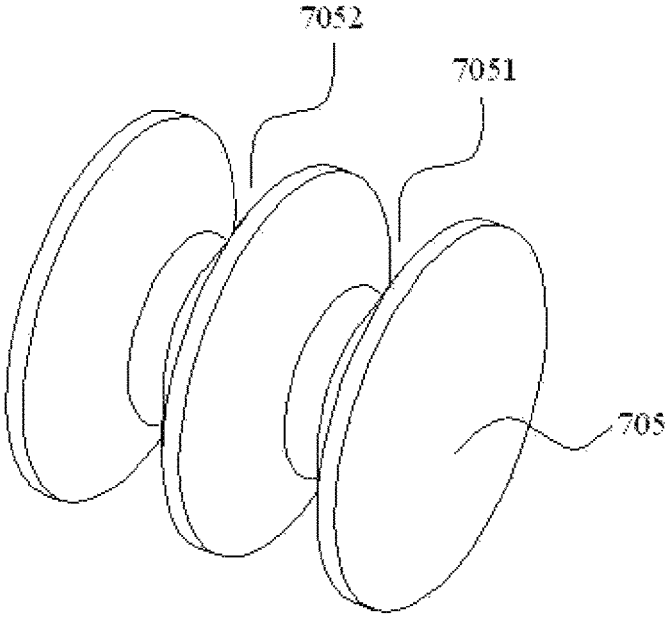
FIG. 7 is a schematic structure diagram of a driving wheel in the transmission assembly of FIG. 5.

In order to prevent the first transmission rope segment 7061 and the second transmission rope segment 7062 wound onto the driving wheel 705 from interfering with each other, as shown in FIG. 7, a first guide groove 7051 and a second guide groove 7052, which are in parallel to each other, are preferably provided along an outer circumference of the driving wheel 705; and the first transmission rope segment 7061 is passed over the first guide wheel 703 and wounded into the first guide groove 7051 in a first direction, and is fixedly connected to the first guide groove 7051; and the second diving rope segment 7062 is passed beneath the second guide wheel 704 and wounded into the second guide groove 7052 in a direction opposite to the first direction, and is fixedly connected to the second guide groove 7052. Therefore, when the secondary door 4 moves from the opened position to the closed position, the output shaft of the motor 6 drives the driving wheel 705 to rotate counterclockwise so as to: pull the first transmission rope segment 7061 so that the first transmission rope segment 7061 is gradually wound into the guide groove 7051; and to release the second transmission rope segment 7062 so that the second transmission rope segment 7062 is gradually separated from the second guide groove 7052, and as a result, transmission rope located between the first guide wheel 703 and the second guide wheel 704 moves upward because of being partially stressed, and then, guided by the guide block 701 and the guide rail 3 in terms of direction, pulls the sliding bottom plate 702 in order to drive the secondary door 4 to move upward to reach the closed position. Therefore, by designing the driving wheel 705 in a structure having two guide grooves can separate the first transmission rope segment 7061 and the second transmission rope segment 7062 wound onto the driving wheel 705 from each other, thereby preventing increasing the resistance of the movement of the secondary door due to the contact and friction between the first transmission rope segment 7061 and the second transmission rope segment 7062 during the transmission.

Wherein, a length of the transmission rope 706 wound onto the driving wheel 705 should be enough to allow for a stroke traveled by the secondary door between the fully enclosed position and the fully opened position. As such, the whole movement of the secondary door between the fully enclosed position and the fully opened position can be ensured. Specifically, when the secondary door is in the fully enclosed position (that is, the position shown in FIG. 5), the length of the transmission rope 706 wound into the first guide groove 7051 should be equal to or greater than the stroke.

It should be noted that, when the secondary door moves to a limiting position, the portion of the transmission rope 706 wound onto the driving wheel 705 may have been fully released. Such limiting cases are also in the explanation scope of the "wind" in the embodiment of the present invention.

In the above embodiment, the transmission rope 706 can be a whole rope, and can also be separated into two segments. When the transmission rope 706 is a whole rope, the middle portion of the transmission rope 706 penetrates through and is connected with the sliding bottom plate 702. When the transmission rope 706 is separated into two segments, as shown in FIG. 6, the two transmission ropes are connected with an upper end and a lower end, of the sliding bottom plate 702, respectively.

Figure 8:
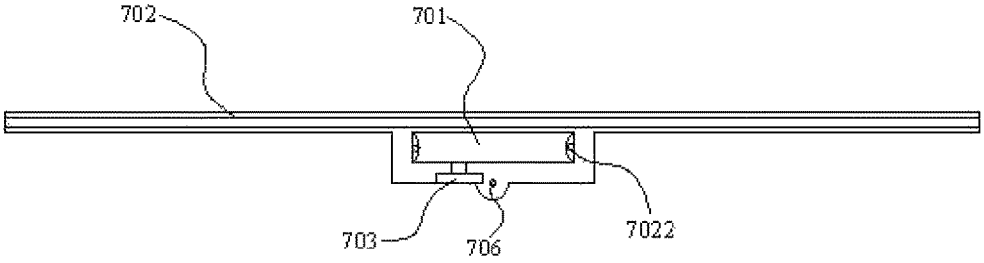
FIG. 8 is a partially top view of the transmission assembly of FIG. 5.

As shown in FIG. 8, in order to reduce the friction force when the sliding bottom plate 702 slides along the guide block 701, pulleys 7022 can be provided between the sliding bottom plate 702 and the guide block 701. Specifically, rotary pulleys 7022 can be provided on an inner wall of the sliding bottom plate 702 in contact with the guide block 701, and then the sliding bottom plate 702 is sleeved onto the guide block 702. Therefore, the sliding between the sliding bottom plate 702 and the guide block 701 is supported by the pulleys 7022, so that the friction force when the sliding bottom plate 702 slides along the guide block 701 becomes a rolling fiction force which significantly reduces the movement resistance of the secondary door.

Wherein, the transmission rope 706 is preferably made of a steel rope which is more resistant to loss.

As shown in FIG. 6, in order to realize a more stable connection between the sliding bottom plate 702 and the secondary door 4, it is preferable to form a mounting groove 7021 on a surface of the sliding bottom plate 702 facing the secondary door. An edge of the secondary door is clamped into the mounting groove 7021. Therefore, it may prevent the secondary door and the sliding bottom plate 702 from being separated during the transmission.

Figure 10:
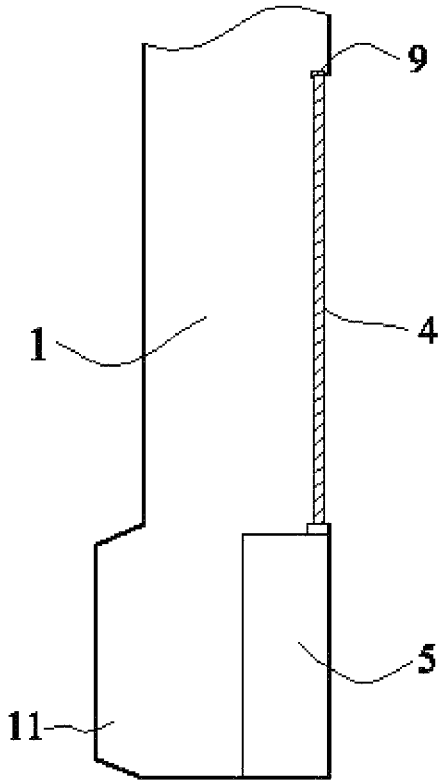
FIG. 10 is a side view of the main door when a thickening layer is provided, according to one embodiment of the present invention.

Because the driving mechanism 5 of the secondary door 4 is arranged inside the door body of the main door 1, a thickness of a foam layer on the main door 1 at a corresponding position is reduced, and as a result, the thermal insulation performance of the main door 1 is decreased. In order to keep the thermal insulation performance of the main door 1, as shown in FIG. 10, a thickening layer 11 which is protruded from a surface of an inner wall is provided on the inner wall of the main door 1 at a position corresponding to the driving mechanism 5. By the arrangement of the thickening layer 11, the thermal insulation performance of the main door 1 may be enhanced.

Figure 11:
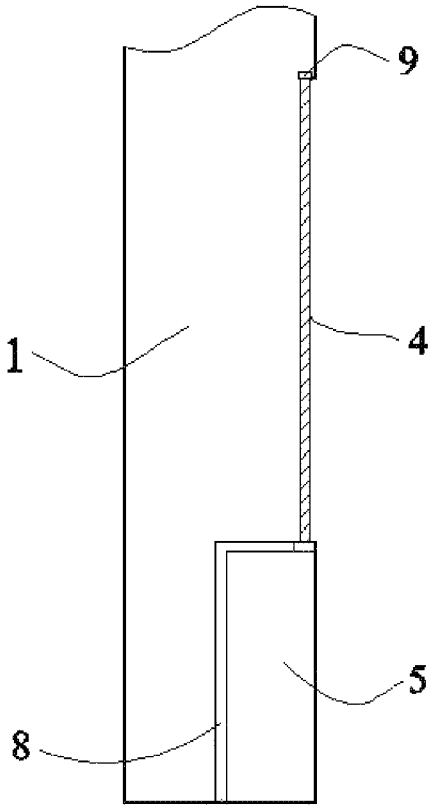
FIG. 11 is a side view of the main door when a vacuum insulation panel is provided, according to one embodiment of the present invention.
Figure 12:
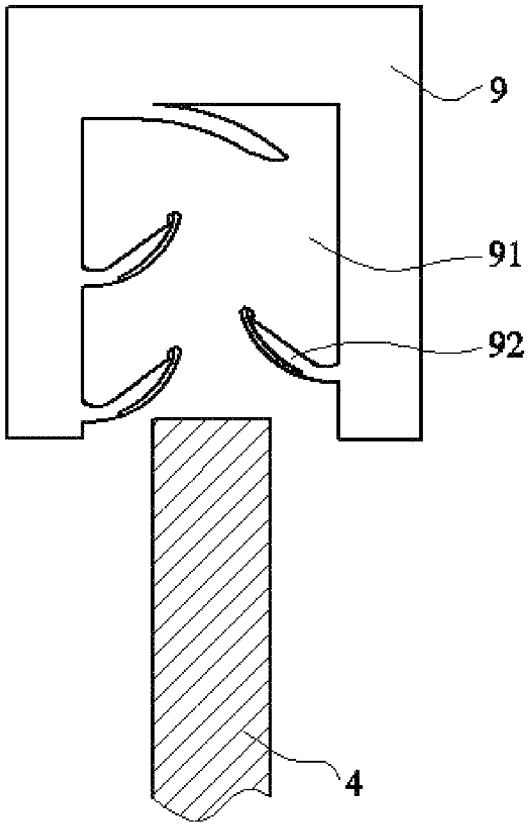
FIG. 12 is a schematic diagram when a sealing strip is not in contact with the secondary door, according to one embodiment of the present invention.
Figure 13:
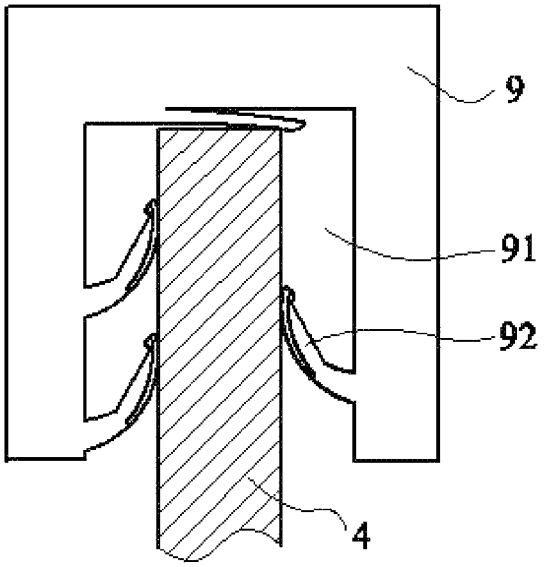
FIG. 13 is a schematic diagram when the sealing strip is in contact with the secondary door, according to one embodiment of the present invention.

In addition, with reference to FIG. 11, a vacuum insulation panel 8 is provided on an external surface of the driving mechanism 5. By the arrangement of the vacuum insulation panel 8, the thermal insulation performance of the main door 1 is enhanced.

With reference to FIG. 10 to FIG. 13, in order to ensure the sealing performance of the opening 2 when the secondary door 4 is closed, a sealing strip 9 is provided around an inner wall of the opening 2, a groove 91 is provided on one side of the sealing strip 9 facing the secondary door 4, and elastic projections 92 are provided inside the groove 91; and when the secondary door 4 is closed, an edge of the secondary door 4 can be extended into the groove 91 to press against the elastic projections 92. At this time, the elastic projections 92 are in close contact with the secondary door 4, which ensures the sealing performance of the opening 2 when the secondary door is closed.

To prolong the service life of the elastic projections 92 and improve the sealing performance and easy sliding at the junction of the secondary door 4 and the sealing strip 9, external surfaces of the elastic projections 92 are planted with fluff by flocking. Therefore, the friction resistance of the elastic projections 92 is increased, thereby prolonging the service time of the elastic projections 92 and improving the sealing performance and easy sliding at the junction of the secondary door 4 and the sealing strip 9.

Because the sealing strip 9 is arranged on the inner wall of the opening 2 and a temperature on the inner wall of the opening 2 is relatively low, the sealing strip 9 is required to keep a good elasticity at low temperature, so as to ensure the sealing performance of the opening 2. The material of the sealing strip 9 is preferably EPDM (Ethylene-Propylene-Diene Monomer), TPE (Thermoplastic Elastomer) or TPR (Thermoplastic Rubber). The three materials mentioned above have a good elasticity at low temperature, so that the sealing performance of the opening 2 is ensured.

In order to enhance the thermal insulation performance of the refrigerator, the secondary door 4 is made of heat insulating glass. The heat insulating glass may prevent cooling capacity inside the refrigerator from leaking, so that the thermal insulation performance of the refrigerator is enhanced. In addition, users may also check the storage condition of goods from the secondary door 4, when the main door 1 and the secondary door 4 are both closed. It is helpful to fetch goods.

Figure 9:
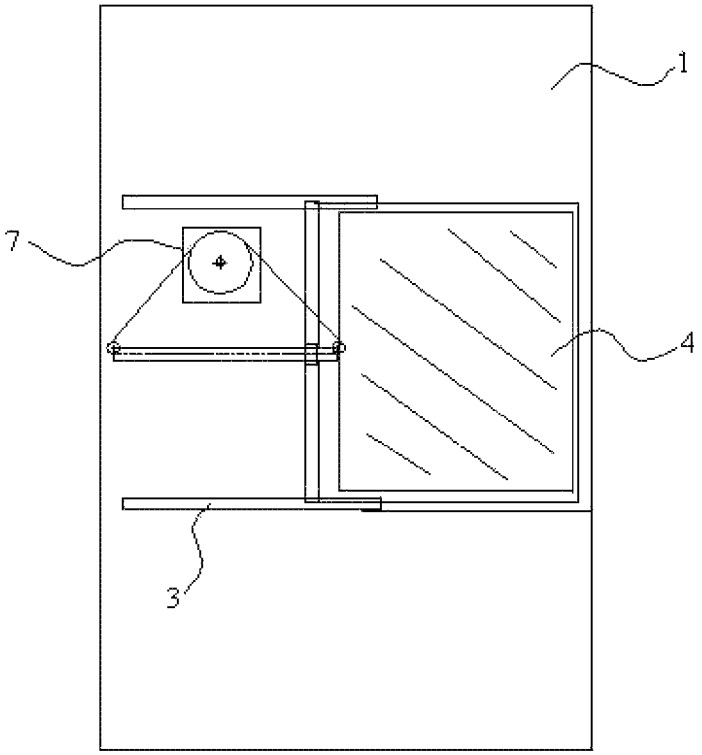
FIG. 9 is a schematic structure diagram in which a guide rail of the refrigerator is arranged in a horizontal direction, according to one embodiment of the present invention.

The guide rail 3 in this embodiment can be arranged in a vertical direction, and in this case, the secondary door 4 can slide up and down along the guide rail 3. In addition, as shown in FIG. 9, the guide rail 3 can also be arranged in a horizontal direction, and in this case, the secondary door 4 can slide left and right along the guide rail 3. If a storage rack is horizontally arranged inside the main door 1, when the guide rail 3 is arranged in a horizontal direction, users may fetch only goods on half of the storage rack even if the secondary door 4 is fully opened; and when the guide rail 3 is arranged in a vertical direction, users may fetch goods on the whole storage rack even if the secondary door 4 is partially opened. For example, users only need to open the upper part of the secondary door 4 to fetch goods on the upper layer of the storage rack, and this thus reduces the loss of cooling capacity. Therefore, it is preferable to arrange the guide rail 3 in a vertical direction.

Figure 14:
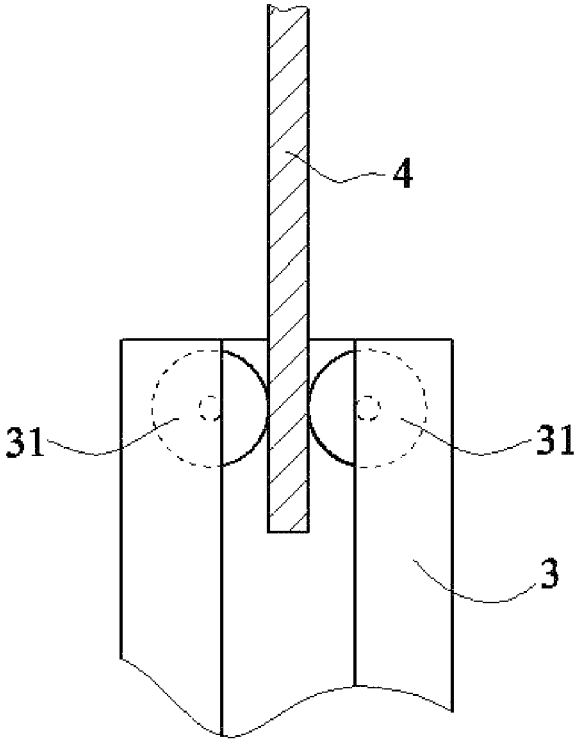
FIG. 14 is a schematic diagram when a guide wheel is provided in a guide rail, according to one embodiment of the present invention.

With reference to FIG. 14, in order to make the secondary door 4 slide more stably along the guide rail 3, a rotary guide wheel 31 is provided on inner walls of two sides of the guide rail 3, when the secondary door 4 slides along the guide rail 3, the surfaces of the two sides of the secondary door 4 are fitted to the guide wheel 31, respectively. The position of the secondary door 4 is limited by the guide wheel 31, thereby preventing the secondary door 4 from swinging toward the two sides during the sliding and allowing the secondary door 4 to slide more smoothly and stably along the guide rail 3. In addition, the material of the guide wheel 31 is preferably rubber or nylon, and this may prevent the guide wheel 31 from scratching the glass secondary door 4 to influence the appearance.

The above description is merely specific implementation of the present invention, and the protection scope of the present invention is not limited thereto. Changes or replacements readily obtained by any technical person who is familiar with the technical field within the disclosed technical scope of the present invention should be included in the protection scope of the present invention. Therefore, the protection scope of the present invention should be subject to the protection scope of the claims.

What is claimed is:

1. A refrigerator, comprising a main door, an opening is formed on a door body of the main door; a guide rail is provided at an edge of the opening, and a secondary door is fitted on the guide rail; and the secondary door is connected with a driving mechanism which can drive the secondary door to slide along the guide rail to enclose or open the opening;

wherein, the driving mechanism comprises a motor and a transmission assembly; an output shaft of the motor is connected to the transmission assembly, and the transmission assembly is connected to the secondary door; and the transmission assembly can transform a rotary motion of the motor output shaft to a linear motion to drive the secondary door to slide along the guide rail;

wherein, the driving mechanism is arranged inside the door body of the main door, and a thickening layer which is protruded from a surface of an inner wall provided on the main door at a position corresponding to the driving mechanism; wherein, a vacuum insulation panel is provided on an external surface of the driving mechanism, and wherein a plurality of rotary guide wheels are provided on inner walls of a side of the guide rail, and a plurality of rotary guide wheels are provided on inner walls of another side of the guide rail; when the secondary door slides along the guide rail, a surface of a side of the secondary door is fitted between rotary guide wheels which are oppositely disposed, and a surface of another side of the secondary door is fitted between rotary guide wheels which are oppositely disposed.

2. The refrigerator according to claim 1, wherein the transmission assembly comprises a first gear, a first connecting rod and a second connecting rod; the first connecting rod is connected to the door body of the main door by a first shaft, and the first connecting rod is rotatable about the first shaft; the second connecting rod is hinged with the first connecting rod by a second shaft; the first gear is fixed onto the output shaft of the motor; one end of the first connecting rod is a gear structure, and the other end thereof is connected with a first guide pin; the gear structure is engaged with the first gear; a first chute perpendicular to the guide rail is provided on one side of the secondary door close to the driving mechanism, and the first guide pin is fitted inside the first chute; one end of the second connecting rod is connected with a second guide pin and another end thereof is connected with a third guide pin, and the second guide pin is fitted inside the first chute; and a second chute perpendicular to the guide rail is provided on the door body of the main door, and the third guide pin is fitted inside the second chute.

3. The refrigerator according to claim 2, wherein the gear structure is a sector gear structure.

4. The refrigerator according to claim 1, wherein the transmission assembly comprises a first gear, a first connecting rod and a second connecting rod; the first connecting rod is connected to the door body of the main door by a first shaft, and the first connecting rod is rotatable about the first shaft; the second connecting rod is hinged with the first connecting rod by a second shaft; the first gear is fixed onto the output shaft of the motor; one end of the first connecting rod is a gear structure, and the other end thereof is connected with a first guide pin; the gear structure is engaged with the first gear; a first chute perpendicular to the guide rail is provided on one side of the secondary door close to the driving mechanism, and the first guide pin is fitted inside the first chute; one end of the second connecting rod is connected with a second guide pin and the other end thereof is connected with a third guide pin, and the second guide pin is fitted inside the first chute; and a support rod perpendicular to the guide rail is provided on the door body of the main door, a second chute is formed on the support rod, and the third guide pin is fitted inside the second chute.

5. The refrigerator according to claim 4, wherein the gear structure is a sector gear structure.

6. The refrigerator according to claim 1, wherein the transmission assembly comprises a transmission gear, a rack and a rack guide rail; the rack guide rail is fixed onto the door body of the main door, the gear guide rail is in parallel to the guide rail, and the rack is slidable along the rack guide rail and one end of the rack is connected to the secondary door; and the transmission gear is connected with the output shaft of the motor in a transmission way, and engaged with the rack.

7. The refrigerator according to claim 6, wherein the transmission gear includes a third gear and a fourth gear, there are two racks and two rack guide rails; the two racks are spaced apart from each other and in parallel to the guide rail, and one end of each of the two racks is connected with the secondary door; the two rack guide rails are spaced apart from each other and in parallel to the guide rail; the two racks are fitted on the two rack guide rails, respectively; the third gear is fixed on the output shaft of the motor, and is engaged with one rack and the fourth gear, respectively; the fourth gear is engaged with the other rack.

8. The refrigerator according to claim 1, wherein the transmission assembly comprises a guide block which is arranged along a direction in parallel to the guide rail; at both ends of the guide block, a first guide wheel and a second guide wheel are provided, respectively; a driving wheel is sleeved on the motor output shaft; the secondary door comprises a sliding bottom plate which is sleeved on the guide block, and the sliding bottom plate is located between the first guide wheel and second guide wheel and connected with a transmission rope; the transmission rope comprises a first transmission rope segment and a second transmission rope segment which are located on both sides of the sliding bottom plate, respectively; and the first transmission rope segment is passed over the first guide wheel and wound onto the driving wheel in a first direction, and the second transmission rope segment is passed beneath the second guide wheel and wound onto the driving wheel in a direction opposite to the first direction.

9. The refrigerator according to claim 8, wherein a portion of the transmission rope located between the first guide wheel and the second wheel is in parallel to the guide rail.

10. The refrigerator according to claim 8, wherein a first guide groove and a second guide groove, which are in parallel to each other, are provided along an outer circumference of the driving wheel; and the first transmission rope segment is passed over the first guide wheel and wounded into the first guide groove in a first direction, and the second diving rope segment is passed beneath the second guide wheel and wounded into the second guide groove in a direction opposite to the first direction.

11. The refrigerator according to claim 8, wherein rotary pulleys are provided on an inner wall of the sliding bottom plate in contact with the guide block.

12. The refrigerator according to claim 8, wherein an external surface of each of the elastic projections comprises flocking.

13. The refrigerator according to claim 1, wherein a sealing strip is provided around an inner wall of the opening, a groove is provided on one side of the sealing strip facing the secondary door, and elastic projections are provided inside the groove; and when the secondary door is closed, an edge of the secondary door can be extended into the groove to press against the elastic projections.

14. The refrigerator according to claim 1, wherein the secondary door is made of heat insulating glass.

15. The refrigerator according to claim 1, wherein the guide rail is arranged in a vertical direction, and the secondary door is slidable along the guide rail up and down.

16. A refrigerator, comprising a main door, an opening is formed on a door body of the main door; a guide rail is provided at an edge of the opening, and a secondary door is fitted on the guide rail; and the secondary door is connected with a driving mechanism which can drive the secondary door to slide along the guide rail to enclose or open the opening;

wherein, the driving mechanism comprises a motor and a transmission assembly; an output shaft of the motor is connected to the transmission assembly, and the transmission assembly is connected to the secondary door; and the transmission assembly can transform a rotary motion of the motor output shaft to a linear motion to drive the secondary door to slide along the guide rail;

wherein, the transmission assembly comprises a first gear, a first connecting rod and a second connecting rod; the first connecting rod is connected to the door body of the main door by a first shaft, and the first connecting rod is rotatable about the first shaft; the second connecting rod is hinged with the first connecting rod by a second shaft; the first gear is fixed onto the output shaft of the motor; one end of the first connecting rod is a gear structure, and the opposite end thereof is connected with a first guide pin; the gear structure is engaged with the first gear; a first chute perpendicular to the guide rail is provided on one side of the secondary door close to the driving mechanism, and the first guide pin is fitted inside the first chute; one end of the second connecting rod is connected with a second guide pin and another end thereof is connected with a third guide pin, and the second guide pin is fitted inside the first chute; and a second chute perpendicular to the guide rail is provided on the door body of the main door, and the third guide pin is fitted inside the second chute.

17. The refrigerator according to claim 16, wherein the gear structure is a sector gear structure.

18. The refrigerator according to claim 16, wherein a support rod perpendicular to the guide rail is provided on the door body of the main door, and a second chute is formed on the support rod, and the third guide pin is fitted inside the second chute.

19. The refrigerator according to claim 16, wherein a sealing strip is provided around an inner wall of the opening, a groove is provided on one side of the sealing strip facing the secondary door, and elastic projections are provided inside the groove; and when the secondary door is closed, an edge of the secondary door can be extended into the groove to press against the elastic projections.

* * * * *